United States Patent [19]

Gerena

[11] 3,949,993

[45] Apr. 13, 1976

[54] GAME TO BE PLAYED WITH CARDS AND PIECES

[75] Inventor: William Gerena, Hato Rey, P.R.

[73] Assignee: Government of the Commonwealth of Puerto Rico, P.R.

[22] Filed: Aug. 14, 1973

[21] Appl. No.: 388,259

[52] U.S. Cl. ..... 273/135 B; 273/136 R

[51] Int. Cl.[2] ..... A63F 3/06

[58] Field of Search ..... 273/130 H, 131 B, 134 G, 273/135 B, 135 R, 136 R, 135

[56] References Cited

UNITED STATES PATENTS

| | | | |
|---|---|---|---|
| 88,421 | 3/1869 | Slagle | 273/135 B |
| 2,409,584 | 10/1946 | Peterman | 273/135 B |
| 2,545,415 | 3/1951 | Podd | 273/135 R |
| 3,111,320 | 11/1963 | Acosta | 273/135 B |
| 3,549,150 | 12/1970 | Weeks | 273/135 B |

FOREIGN PATENTS OR APPLICATIONS

| | | | |
|---|---|---|---|
| 5,015 | 1903 | United Kingdom | 273/135 R |

*Primary Examiner*—Richard C. Pinkham
*Assistant Examiner*—Harry G. Strappello
*Attorney, Agent, or Firm*—Scrivener Parker Scrivener and Clarke

[57] ABSTRACT

A game to be played by filling in numbered and lettered spaces on a card with numbered chips and lettered chips, comprises 26 playing cards each of which is star-shaped with eight corners and is centrally marked with one letter of the alphabet and a diamond-shaped outline. Each of the eight corners or apices of the card, and each of two of the corners of the diamond figure, is marked with a number and the numbers are colored to correspond to colors of the numbered chips. The game is played by drawing numbered chips and lettered chips from a canister and placing them on correspondingly numbered, lettered and colored spaces on a card until one player has fulfilled some agreed rule of the game, such as completely filling the numbered and lettered spaces on his card with correspondingly numbered, lettered and colored chips.

1 Claim, 5 Drawing Figures

Fig. 1
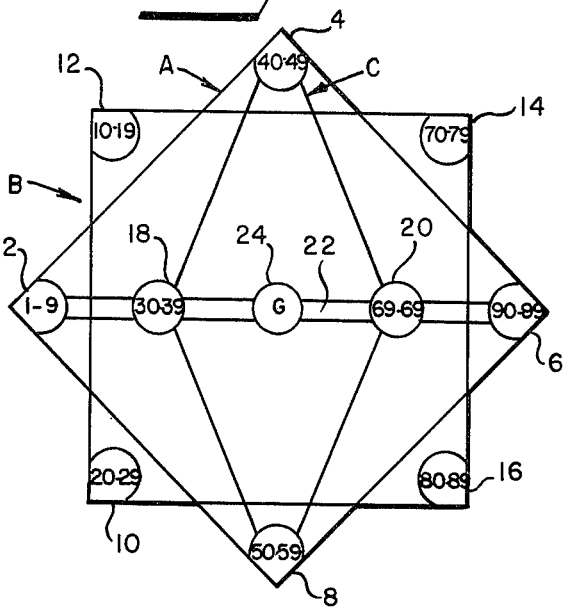
Fig. 2
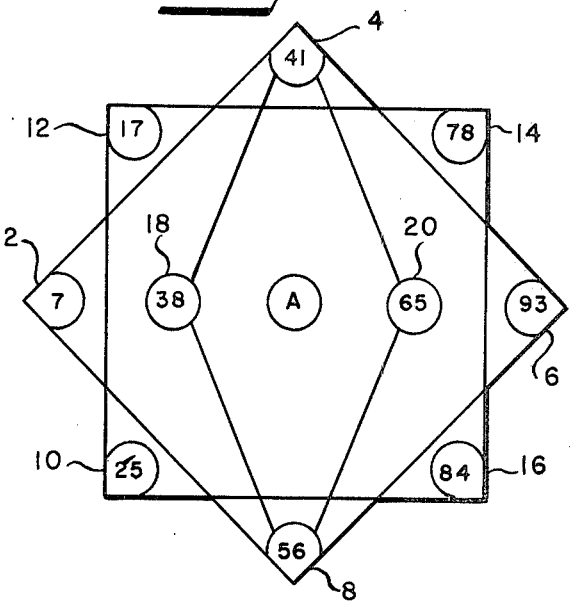
Fig. 3
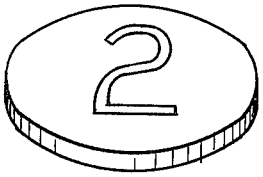
Fig. 4
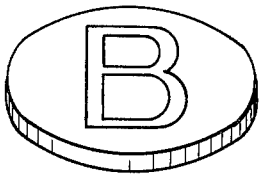
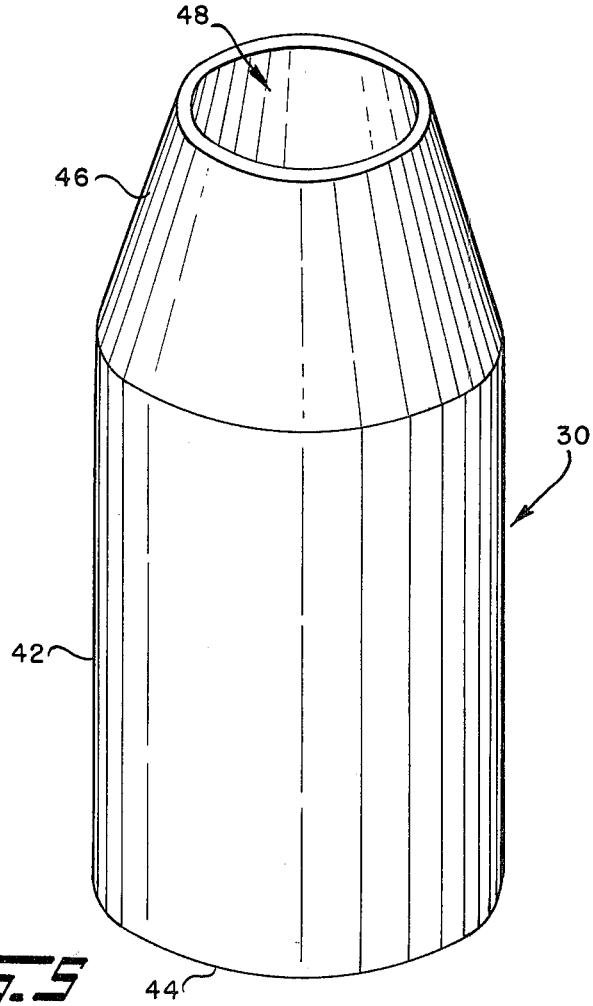
Fig. 5

GAME TO BE PLAYED WITH CARDS AND PIECES

BACKGROUND OF THE INVENTION

Games, such as Bingo, in which numbered or lettered chips are placed on correspondingly numbered or lettered spaces on a card, are very popular and are used for pleasure, recreation and profit. The present invention is a game of the same general type but having novel pieces, arrangements and methods of play.

SUMMARY OF THE INVENTION

The game pieces are 26 specially shaped cards each of which is marked with one letter of the alphabet and ten spaces on each of which is marked one number of a series of nine consecutive numbers forming part of the series of numbers 1 to 99, all of the 99 numbers being used, some more than once. Ninety-nine number chips and 26 letter chips are placed in a canister and withdrawn at random by successive players until some player has completed his card or a part of it in accordance with agreed rules.

DESCRIPTION OF THE DRAWINGS

FIG. 1 is a plan view of a card showing the coloring and arrangement of number groups and letters on the card;

FIG. 2 is a plan view of a typical card;

FIG. 3 is a perspective view of a typical numbered chip;

FIG. 4 is a perspective view of a typical lettered chip, and

FIG. 5 is a perspective view of the canister which holds the chips in playing the game.

DESCRIPTION OF THE INVENTION

In FIG. 1 of the drawings there is disclosed, for purposes for illustration only, the configuration of one of the cards forming part of the deck of 26 cards which are used in playing the game according to the invention. Each of these cards is shaped as two superimposed squares A and B turned at 45° to each other so that eight corners or apices are presented, the card having the general configuration of an eight-pointed star. It will be seen that one of these squares A has the corners 2, 4, 6, 8 while the other square B has the corners 10, 12, 14, 16. The square A is defined by a blue border and square B is defined by a black border. On the central part of the card there is marked a diamond shape which is denoted by the letter C and which is formed by red lines. In the disclosed embodiment the diamond figure extends between the corner 4, 8 of square A and has the intermediate corners 18, 20. A blue band 22 extends across the card from corner 2 to corner 6 and has a space 24 at its midpoint.

At each corner of the card and at the corners 18, 20 of the diamond figure there is provided a space or area on which one of a series of numbers is marked, the numbering at the various corners being done in accordance with the following arrangement and relation:

| Corner | Number Series |
|---|---|
| 2 | 1 to 9 |
| 12 | 10 to 19 |
| 10 | 20 to 29 |
| 18 | 30 to 39 |
| 4 | 40 to 49 |
| 8 | 50 to 59 |
| 20 | 60 to 69 |

-continued

| Corner | Number Series |
|---|---|
| 14 | 70 to 79 |
| 16 | 80 to 89 |
| 6 | 90 to 99 |

While numbers of other series may be placed on the corner spaces at corners 2 to 20 the numbering arrangement set forth in this table is preferred and has been found to produce good results in playing the game.

On the space 24 which is at the center of the card and at the center of the band or stripe 22 there is marked one of the letters of the alphabet in capital script, the letter G being shown in FIG. 1 by way of example. As there are 26 cards in the deck all of the letters of the alphabet will be represented in the full deck.

Twenty-six cards compose the deck of cards which are used in the game, a typical card being shown in FIG. 2 of the drawings, and it will be observed that in each of the corners 2 to 20 there is marked a number which is one of the numbers of the series of numbers assigned to that corner in accordance with the table set forth above. It will also be observed that as there are 26 cards and each card has 10 numbers there will be 260 corner numbers in the entire deck, and as there are only 99 numbered chips, as will be described, many of the numbers will be repeated in the entire deck of cards.

In addition to the cards the game pieces include 99 numbered chips, one of which is shown in FIG. 3 of the drawing, and each of which bears one of the numbers from 1 to 99. These chips are sufficiently small in size so that each may be placed on the space provided at each of the corner spaces 2 to 24 of each card. Each chip is white and the number on each chip is blue.

In addition to the number chips the game pieces include 26 letter chips, one of which is shown in FIG. 4 of the drawings. These chips are the same size as the number chips and each bears one of the letters of the alphabet in capital script. Each letter chip is white and the letter printed thereon is green.

In addition to the cards, the number chips and the letter chips there is provided as a part of the game a canister 30 which is shown in FIG. 5 of the drawings, within which the number and letter chips are placed. The canister comprises a lower cylindrical part 42 having a bottom 44, and above this there is an upper part 46 shaped as a truncated cone having at its upper end an opening 48 of a size which will permit the number and letter chips to be inserted into and withdrawn from the canister.

In playing the game the 99 number and the 26 letter chips are randomly placed in the canister and the cards are distributed among the players, of whom there can be any number. Each player in turn withdraws a chip from the canister, which may by chance be either a number or a letter chip. If it corresponds to one of the numbers or one of the letters on the card which the player holds he places it on that number or letter. The game may be won in accordance with rules which are agreed to by the players, among which may be the following:

1. The winner is the holder of the first letter chip drawn.
2. The winner is the first player to fill all spaces on the blue line 22.

3. The winner is the first player to fill all spaces on the blue square A.
4. The winner is the first player to fill all spaces on the red diamond C.
5. The winner is the first player to fill all spaces on the card.

I claim:

1. A game to be played by any number of players, comprising 26 cards each of which is shaped as an eight-pointed star having a diamond marked thereon with two corners, thus providing a total of 10 corners on each of which there is marked one number of a series of numbers which are assigned to that corner, a stripe extending across the card and connecting opposite corners, a letter of the alphabet marked at the center of the stripe, 99 chips each marked with one of the numbers from 1 to 99, 26 chips each marked with a letter of the alphabet, and a canister in which all of the chips are placed in random and from which they are drawn by successive players and placed on the corresponding number or letter on the player's card.

* * * * *